United States Patent [19]

Herbert et al.

[11] Patent Number: 4,910,921

[45] Date of Patent: Mar. 27, 1990

[54] ROLLING EDGE PUNCH ASSEMBLY

[76] Inventors: Roger J. Herbert, River Rd., Washngton Depot, Conn. 06794; Thomas M. Aurio, 17 Sunset La., Wolcott, Conn. 06716; Alfred F. Stanco, 131 Edin Ave., Waterbury, Conn. 06706

[21] Appl. No.: 226,479

[22] Filed: Aug. 1, 1988

[51] Int. Cl.[4] ..... B24B 5/00

[52] U.S. Cl. ..... 51/90; 51/290; 82/113

[58] Field of Search ..... 82/113, 331; 51/90, 51/241 B, 241 A, 241 S; 413/6, 11; 72/178, 181, 203, 214, 243

[56] References Cited

U.S. PATENT DOCUMENTS

| | | | |
|---|---|---|---|
| 3,387,480 | 6/1968 | Eaker et al. | 72/203 |
| 3,724,303 | 4/1973 | Rinaldo | 82/113 |
| 3,744,356 | 7/1973 | Slator et al. | 82/113 |
| 3,772,944 | 11/1973 | Becker et al. | 82/113 |
| 4,739,682 | 4/1988 | Birkestrand | 82/113 |

*Primary Examiner*—Frederick R. Schmidt
*Assistant Examiner*—Mark F. Frazier
*Attorney, Agent, or Firm*—Chilton, Alix & Van Kirk

[57] ABSTRACT

A rotary edge assembly for finishing the circumferential edge of a shell-like workpiece is adapted for incorporation into an eyelet punch-type press work station. A pair of rollers are diametrically positionable for rotation about a work axis. The press head moves the rollers into an engaging operational relationship with a workpiece for rotation along the edge. An adjustment knob is threaded to a saddle member for adjusting the position of the rollers for a given workpiece.

17 Claims, 4 Drawing Sheets

ROLLING EDGE PUNCH ASSEMBLY

BACKGROUND OF THE INVENTION

This invention relates generally to punch type presses and machines for stamping and forming cup or shell-like workpieces such as container caps and the like. More particularly, this invention relates generally to devices for removing the sharpened edges of such workpieces.

Conventional punch and die machines and techniques which are used to form container caps produce a rough, unfinished outer edge at the sidewall of the container cap. In the packaging industry, an elegant smooth finish to the container cap is often desired. In addition, it is advantageous to smooth the outer edge to prevent cuts from accidental contact with the edge and also to prevent damage to the closure or container to which the cap is applied.

SUMMARY OF THE INVENTION

Briefly stated, the invention in a preferred formed is a rotary edge cutter assembly. The cutter assembly comprises a holder assembly which receives a shell-like workpiece having a circumferential unfinished edge. The holder assembly holds the workpiece in fixed relationship about a central first axis through the workpiece. An edge cutter comprises two rollers which are diametrically positionable about the first axis and are rotatable about a second locus of axes which are orthogonal to the first axis. The rollers trim the unfinished workpiece edge. The rollers are each mounted to a saddle. A pulley coaxial with first axis is driven for rotating the edge cutter rollers about the first axis. A screw is threaded to a saddle and a knob rotates the screw for adjusting the position of the rollers relative to the first axis. An overhead press mounts the edge cutter assembly for displacing the edge cutter assembly along the first axis. In one axial positional mode, the cutter assembly does not contact the workpiece. In a second axial positional mode, the cutter engages the workpiece and rotates the rollers about the first axis to thereby traverse the unfinished workpiece edge to smooth the edge of the workpiece.

The holder assembly comprises a pair of jaw members which define a receiving cavity. The jaw members are biased apart and a follower is positionable for clamping the jaw members together. The roller comprises two axially spaced integrally connected carbide wheels having unequal diameters. An axially extending plunger has a head mounted at one end. The plunger head is adapted to be received by a workpiece in the second positional mode for fixing the position of the workpiece. A motor is mounted in fixed relationship with the press and connects via a belt to the pulley for rotating the cutter assembly An ejector ejects the workpiece from the receiving assembly. The plunger head forces the workpiece against the ejector during the operational mode.

An object of the invention is to provide a new and improved rolling edge punch assembly for smoothing the rough edges of the container cap or the like.

Another object of the invention is to provide a new and improved apparatus for smoothing the rough edges of a container cap or the like in a very efficient, high-speed, automated manner.

A further object of the invention is to provide a new and improved apparatus for smoothing the rough edges of formed container cap which apparatus may be efficiently incorporated as a work station into an integrated automated assembly process.

A yet further object of the invention is to provide an apparatus for finishing the edges of a container cap or like object so as to present a highly pleasing aesthetic appearance.

Other object and advantages of the invention will become apparent from the drawings and the specification.

DETAILED DESCRIPTION OF THE INVENTION

Figure 5:
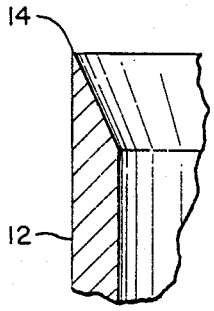
FIG. 5 is an enlarged fragmentary sectional view of a portion of an unfinished workpiece for which the rolling edge punch assembly of the present invention is adapted.
Figure 6:
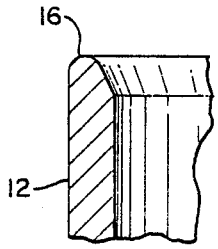
FIG. 6 is an enlarged fragmentary sectional view of a finished form of the workpiece of FIG. 5.

With reference to the drawings wherein like numerals represent like parts throughout the figures, a rolling edge punch assembly in accordance with the present invention is generally designated by the numeral 10. The rolling edge punch assembly 10 is preferably incorporated as a work station of an integrated automated assembly line (not illustrated) wherein cylindrical or cuplike container caps 12 are formed and finished in quasi-continuous fashion. In the preferred application of the punch assembly 10, a cylindrical shell 12 in the form of an unfinished container cap or like object is received as a workpiece in the punch assembly in one step of a manufacturing process. The shell 12 initially has a rough sharpened edge 14 as illustrated in FIG. 5. The punch assembly efficiently operates to smooth and finish the edge to an aesthetically pleasing, elegant, rounded form 16 as best illustrated in FIG. 6. The punch assembly 10 has particular applicability in connection with container caps which are drawn or formed from metals such as aluminum alloys.

Figure 1:
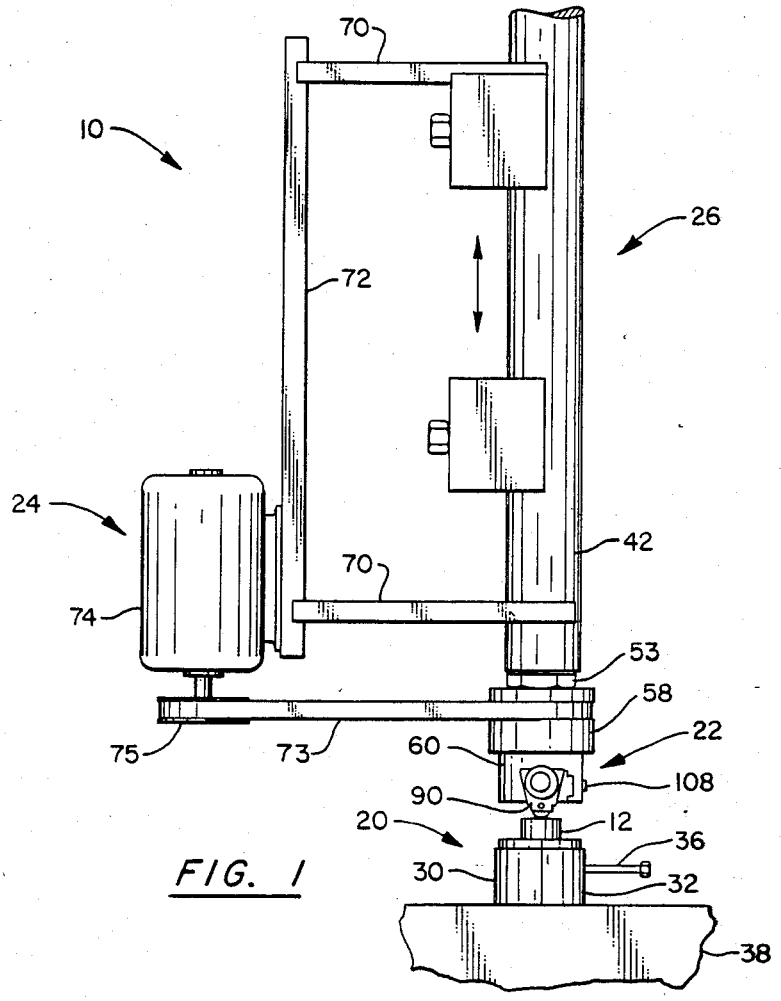
FIG. 1 is a side elevational view of a rolling edge punch assembly accordance with the present invention.
Figure 2:
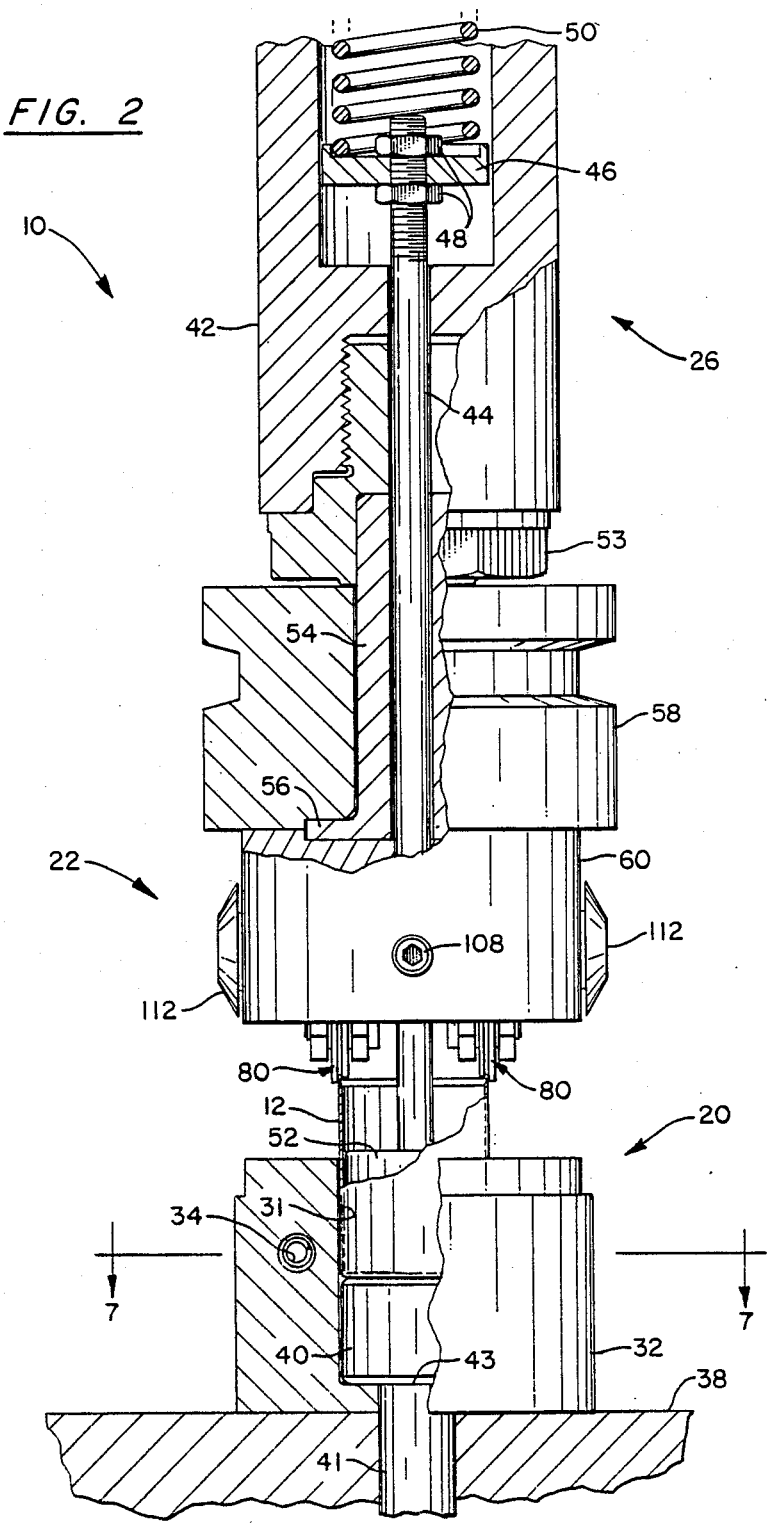
FIG. 2 is an enlarged fragmentary front view, partially in section and partially broken away, of the rolling edge punch assembly of FIG. 1.

With reference to FIGS. 1 and 2, the rolling edge punch assembly 10 generally comprises a number of principal subassemblies. A die or holder assembly 20 receives the shell or workpiece 12, holds the workpiece in position during the cutting or smoothing operation and ejects the finished workpiece from the punch assembly. A rotary cutter assembly 22 engages the workpiece to trim or cut the workpiece edge to thereby smooth or finish the rough sharpened edges of the workpiece. A motor assembly 24 rotates the rotary cutter assembly. An overhead, reciprocating, eyelet-type punch press head 26 mounts the cutter assembly 22 and the motor assembly 24. Means (not illustrated) are provided for sequentially reciprocating the press head 26 in the direction of the arrows for raising and lowering the cutter assembly 22 along a work axis (vertical in the drawings) relative to the received workpiece 12. The rolling edge punch assembly 10 is easily incorporated into a conventional multi-station, eyelet-type punch press system which is electronically controlled.

Figure 7:
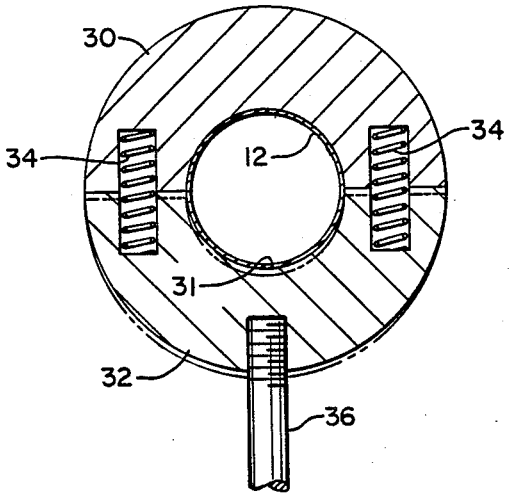
FIG. 7 is an enlarged fragmentary sectional view of the rolling edge punch assembly taken along the line 7—7 of FIG. 2.

With additional reference to FIG. 7, the unfinished shell 12 is received in a holder cavity 31 between a pair of nylon clamp jaw members 30 and 32. The shell 12 is oriented in upright relationship so that the unfinished edge 14 at the open end thereof is upwardly displaced beyond the tops of the jaw members and exposed for finishing as described herein. The jaw members 30 and 32 are semi-annular in shape and are contoured to define the central holder cavity 31. A pair of coiled springs 34 are diametrically positioned in aligned bores so as to bias apart the jaw members. After the shell 12 is received in the holder cavity 31, a socket head follower screw 36 is cammed into position. The follower screw 36 forces the jaw members 30 and 32 into clamping relationship with the shell 12 to firmly hold and fix the position of the shell during the finishing phase and to prevent rotation of the shell during the described finishing process. The socket head follower screw 36 is sequentially cammed into position and synchronized with the automated system by means (not illustrated) activated by a microswitch (not illustrated).

It will be appreciated that the bottom of the shell 12 is located above a die bed or a platform 38 in fixed symmetric relationship with the work axis of the eyelet press assembly. The work axis is vertically oriented in the drawings but the work axis need not be limited to a vertical orientation. The workpiece is preferably loaded in the holder assembly 20 by a linear or rotary transfer member (not illustrated) which moves or rotates into alignment between the eyelet press assembly 26 and the holder assembly 20 so that the finishing process performed by the rolling edge punch assembly 10 may be accomplished.

An ejector 40 defines an upper planar surface or horizontal bed 43 and includes a shaft 41 which projects through the platform. The bottom of the received shell 12 normally rests on the ejector bed 43. The work axis position of the ejector 40 in the workpiece receiving mode may be adjustable to pre-establish the cutting depth of the cutter assembly 22. The ejector 40 is synchronized with the operation of the overall automated assembly so that after the finishing process is completed, the finished shell 12 may be ejected from the holder assembly 20 by a momentary abrupt displacement of the ejector 40.

The press head 26 comprises an overhead generally elongated, tubular arbor 42 which receives the upper portion of a plunger shaft 44. The upper end of the plunger shaft 44 is threaded s as to connect to a thrust plate 46 which is adjustably positionable by means of a pair of cooperative nuts 48. The thrust plate 46 is received in a cavity of the arbor 42 and is longitudinally displaceable therein. The thrust plate 46 is downwardly biased by a plunger spring 50. The opposite end of the shaft 44 mounts a nylon shell pushdown ram 52. The pushdown ram 52 is dimensioned for a given workpiece and is snugly insertable into the received workpiece 12 to immobilize the workpiece during the finishing process and to force the shell to bottom against the top bed 43 of the ejector.

A guide sleeve 53 is interiorly threaded to the arbor 42. The lower outer end of the guide sleeve 53 has a hex-head for torquing the sleeve into a tightened engagement against the arbor 42. The top portion of a sleeve bearing 54 is received in a central lower aperture defined by the guide sleeve 53. The guide sleeve 53 and the sleeve bearing 54 each has an axial opening through which the plunger shaft 44 extends for axial movement. The bearing 54 has a radially projecting flange 56 for axially retaining a coaxially-mounted pulley 58. A cutter head 60 is bolted to the underside of the pulley 58 in rotatably fixed relationship therewith. The pulley 58 is mounted over the bearing 54 so as to provide rotary motion relative to the upper press head assembly 26 (which does not rotate) about the central work axis with the cutter head 60 and pulley 58 rotating in tandem relationship.

A pair of spaced brackets 70 are rigidly connected to the main arbor 42 and laterally project therefrom. The brackets 70 support a generally vertical base 72 which mounts the motor assembly 24. The motor assembly includes an electric motor 74 having a drive pulley 75. A belt 76 connects from the drive pulley 75 to the rotary pulley 58 to impart rotary motion to the cutter assembly 22.

It should be appreciated that the arbor 42 does not rotate. The arbor 42, guide sleeve 53, and bearing 54 have a central axial opening which permits the plunger shaft 44 to move axially relative to the members along the work axis. In addition, the press head 26 and the rotary cutter assembly 22 are displaceable along the work axis as a unit in the direction of the arrows so as to be sequentially raised and lowered relative to the holder assembly 20 and the received workpiece 12. The arbor 42 may be connected or supported by any number of conventional means (not illustrated).

Figure 3:
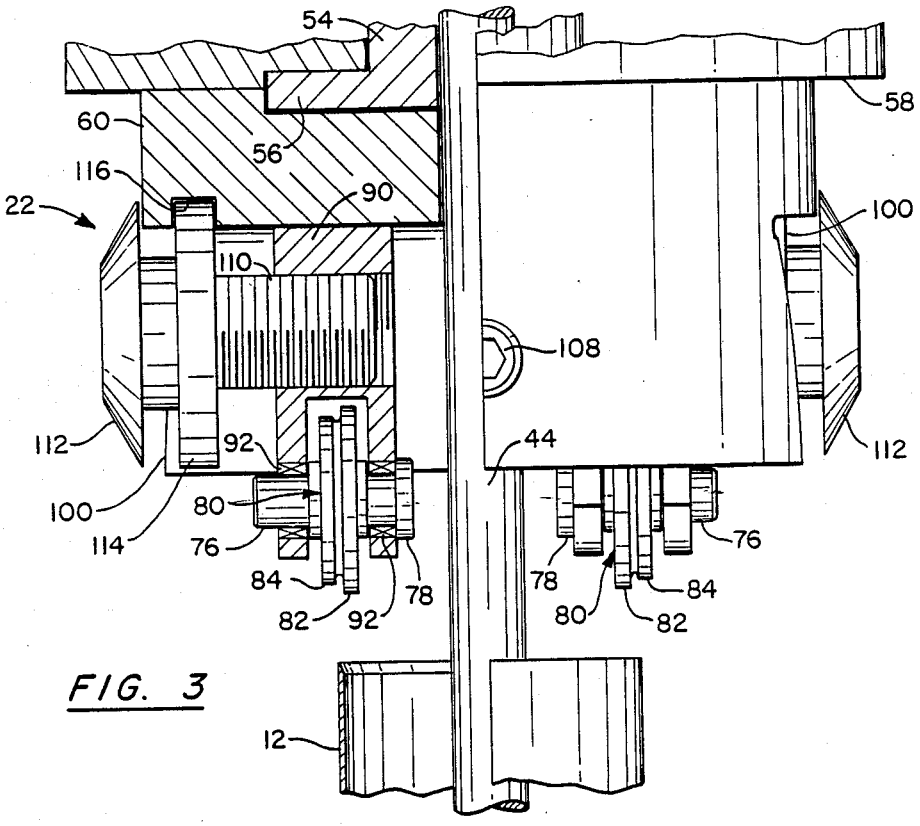
FIG. 3 is an enlarged fragmentary sectional view, partially broken away, of a portion of the rolling edge punch assembly of 2.
Figure 4:
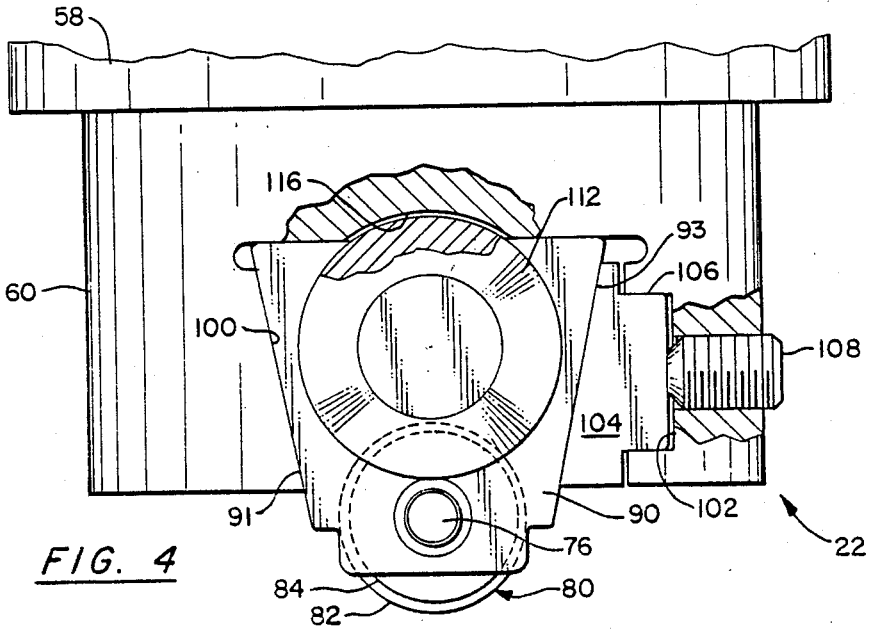
FIG. 4 is a side view, partially broken away, of the punch assembly portion of FIG. 3.

With reference to FIGS. 3 and 4, the rotary cutter assembly 22 comprises a pair of substantially identical carbide rollers 80 which are diametrically positioned relative to the work axis and the plunger shaft 44. The carbide rollers 80 traverse the workpiece edge to simultaneously cut and/or grind the unfinished workpiece edge 14 to produce the smooth finished edge 16. Each roller traverses an arcuate path which subtends an angle of approximately 180° for a given workpiece. Each roller 80 preferably has an integral dual wheel configuration with an enlarged diameter rim 82 and a reduced diameter rim 84. A pair of coaxial shafts 76 and 78 integrally project from the roller wheels for rotatably mounting the rollers.

A transversely displaceable saddle 90 having tapered sides 91 and 93 defines a pair of stirrups which receive needle bearings 92. The shafts 76 and 78 are press-fitted into the needle bearings 92 so that the rollers 80 are freely rotatable about a moveable axis, the locus of which is orthogonal to the work axis. The roller rims 82 and 84 project slightly beyond the underside of the stirrups to present a machining edge for engaging the workpiece.

The cutter head 60 defines a diametral dovetail slot 100 and contiguous transversely extending guide slot 102 for slidably receiving each saddle 90 and associated mounted roller 80. The dovetail slot 100 is in part complementary with the tapered sides 91 and 93 of the saddle. The saddles 90 are secured to the cutter head by a shoe 104 having a rib 106 closely received in the guide slot 102. The shoe 104 wedges against one side of the saddle 90. A socket head set screw 108 secures the shoe 104 into proper engaging position.

An adjustment screw 110 is threaded to each saddle 90 for adjusting the transverse position of the saddle and hence roller 80 relative to the work axis so that a proper positioning of the roller can be obtained for a given workpiece. Each adjustment screw 110 has an integral end adjustment knob 112. An intermediate radial flange 114 is received in an arcuate slot 116 of the cutter head 60. The flange 114 cooperates with the slot defining walls of the cutter head to fix the transverse position of the adjustment screw 110 to thereby transform rotary motion of the screw into linear motion of the associated saddle. The adjustment knob 112 is manually accessible for rotatably adjustably threading the adjustment screw to its associated saddle to thereby define the transverse position of the associated roller 80, i.e. the distance of the roller 80 from the central work axis.

In operation, a transfer arm deposits the shell in the holder assembly cavity 31 as previously described. The press head 26 is then lowered onto the received shell with the nylon ram 52 inserted against the inside bottom of the shell forcing the shell against the ejector 40. The jaw members 30 and 32 are clamped together to rotatably fix the shell. The motor is activated to rotate the rollers relative to the work axis as the rollers 80 downwardly engage the edge 14 of the workpiece and independently rotate upon frictional engagement therewith to roll along the arcuate edge. The edge is transformed to an elegant rounded edge 16 such as illustrated in FIG. 6. The press head 26 is then raised from the workpiece, the ejector 40 ejects the finished workpiece from the holder assembly 20, and the workpiece is sequentially transferred to a different station within the automated assembly. A new unfinished workpiece is deposited in the receiving cavity and the described finishing process is cyclically replicated.

In a preferred application, the shell is a thin walled aluminum container cap having a wall thickness on the order of 0.012 inches to 0.020 inches, plus or minus 0.010 inches. Sixty pieces per minute can be processed by the described rolling edge punch assembly 10. It will be appreciated that the engagement of the carbide rollers 80 along the unfinished edge 14 is ½ second or less. Oil or lubricant is ordinarily applied to the stock material through the shell-forming and finishing steps.

While a preferred embodiment of the invention has been set forth for purposes of illustration, the foregoing description should not be deemed a limitation of the invention. Accordingly, various modifications, adaptations and alternatives may occur to one skilled in the art without departing from the spirit and the scope of the present invention.

What is claimed is:

1. A rotary edge cutter assembly comprising:

receiving means for receiving a shell-like workpiece having a circumferential edge and holding said workpiece in fixed relationship about a central first axis through said workpiece;

edge cutter means for trimming the workpiece edge, said cutter means comprising at least one roller rotatable about a second moveable axis the locus of which is orthogonal to said first axis;

rotary means for rotating said edge cutter means about said first axis;

adjustment means for adjusting the position of said roller relative to said first axis; and press means mounting said edge cutter means for displacing said edge cutter means along said first axis wherein in a first positional mode said cutter means does not contact the workpiece and in a second positional mode said cutter means engages said workpiece edge and rotates about said first axis to thereby traverse said edge.

2. The rotary edge assembly of claim 1 wherein said edge cutter means comprises two rollers diametrically positionable relative to said first axis.

3. The rotary edge assembly of claim 1 wherein said edge cutter means further comprises an adjustably positionable saddle roller and said comprises a wheel and a pair of oppositely projecting shafts, said shafts being mounted to said saddle for rotation.

4. The rotary edge assembly of claim 1 wherein said adjustment means comprises an adjustment knob which connects with an adjustment screw, and said edge cutter means comprises a saddle, said roller being mounted to said saddle for rotation, the position of said saddle being governed by said adjustment screw.

5. The rotary edge assembly of claim 1 wherein said receiving means comprises a pair of jaw member which cooperatively define a receiving cavity.

6. The rotary edge assembly of claim 5 wherein said members are biased apart and further comprising a follower which is positionable for clamping said jaw members together.

7. The rotary edge assembly of claim 1 wherein said roller comprises two axially spaced carbide wheels having unequal diameters.

8. The rotary edge assembly of claim 1 further comprising an axially extending plunger, a ram being mounted at one end of the plunger and adapted to be inserted into said workpiece for fixing the position thereof.

9. The rotary edge assembly of claim 1 wherein said rotary means comprises a motor and a pulley coaxial with said first axis, a belt connecting said motor for driving said pulley.

10. A rotary edge cutter assembly comprising:

receiving means for receiving a shell-like workpiece having a circumferential edge and for holding said workpiece in fixed relationship about a central first axis through said workpiece;

edge cutter means for trimming the workpiece edge, said cutter means comprising two rollers diametrically positionable about said first axis and rotatable about a axis the locus of which is orthogonal to said first axis, said rollers each being rotatably mounted to a saddle;

rotary means comprising a pulley coaxial with said first axis for rotating said edge cutter means about said first axis;

adjustment means for adjusting the position of said rollers relative to said first axis, said adjustment means comprising a rod threaded to a said saddle and a knob for rotating said rod; and press means mounting said edge cutter means for displacing said edge cutter means along said first axis wherein in a first positional mode said cutter means does not contact the workpiece and in a second positional mode said cutter means engages said workpiece edge and rotates about said first axis and said rollers independently rotate to thereby traverse said edge.

11. The rotary edge assembly of claim 10 wherein said receiving means comprises a pair of jaw members which cooperatively define a receiving cavity.

12. The rotary edge assembly of claim 10 wherein said roller comprises two axially spaced integrally connected carbide wheels having unequal diameters.

13. The rotary edge assembly of claim 10 further comprising axially extending plunger, a ram being mounted at one end of the plunger and adapted to be received by said workpiece in said second positional mode for fixing the position thereof.

14. The rotary edge assembly of claim 13 further comprising an ejector means for ejecting said workpiece from said receiving means, said plunger head adapted to force the workpiece against said ejector means.

15. The rotary edge assembly of claim 10 wherein said rotary means comprises a motor and a belt connecting said motor and said pulley for driving said pulley, said motor being mounted in fixed relationship with said press means.

16. The rotary edge assembly of claim 10 further comprising a support means mounted in fixed relationship with said pulley, said support means defining a diametral slot for slidably receiving said saddles.

17. The rotary edge assembly of claim 16 wherein said saddles and said slot have complementary tapered shapes and said saddles are secured in said slot by a shoe which is clamped against said saddles.

* * * * *